United States Patent [19]

Lanes et al.

[11] Patent Number: 4,794,496

[45] Date of Patent: Dec. 27, 1988

[54] HEADBAND LAMP APPARATUS

[76] Inventors: Terry L. Lanes, Box 4407, Polson, Mont. 59860; Carl H. Lanes, 523 Spruce, Anaconda, Mont. 59711

[21] Appl. No.: 79,499

[22] Filed: Jul. 30, 1987

[51] Int. Cl.[4] ..... F21L 15/14

[52] U.S. Cl. ..... 362/105; 362/103

[58] Field of Search ..... 362/103, 105, 183, 804

[56] References Cited

U.S. PATENT DOCUMENTS

| | | | |
|---|---|---|---|
| 2,176,789 | 10/1939 | Capitani | 362/105 |
| 2,539,104 | 1/1951 | Rodel | 362/105 X |
| 3,008,040 | 11/1961 | Moore | 362/105 |
| 3,014,405 | 12/1961 | Swikart | 362/105 X |
| 4,150,302 | 4/1979 | Roche | 362/183 X |
| 4,203,150 | 5/1980 | Shamlian | 362/183 |

FOREIGN PATENT DOCUMENTS

| | | | |
|---|---|---|---|
| 921637 | 12/1954 | Fed. Rep. of Germany | 362/105 |

*Primary Examiner*—Tony M. Argenbright
*Assistant Examiner*—Eric R. Carlberg
*Attorney, Agent, or Firm*—Arthur L. Urban

[57] ABSTRACT

Headband lamp apparatus includes a band portion, a lamp portion, a power supplying portion and a recharging portion. The band portion includes an adjustable elongated flexible band member. The lamp portion includes a lamp socket disposed on a free end of an adjustable linkage. A protective housing surrounding a lamp bulb has an adjustable lens located adjacent a free end of the housing. The power supplying portion includes a plurality of batteries mounted on the band member along the length thereof and spaced from the lamp portion. Each pair of the batteries is retained on the band member with a clip member. Electrical conductors along the length of the band member electrically connect the lamp portion with the batteries. The recharging portion includes a socket member disposed along the length of the band member remote from the lamp portion and connected electrically with the conductors. The socket member includes an elongated cavity with an axis closely adjacent to and transverse of a longitudinal axis of the band member. A recharging assembly includes a male projection selectively engageable with the cavity of the socket member, electrical plug elements and a signal lamp activatable when the apparatus is being recharged.

2 Claims, 1 Drawing Sheet

HEADBAND LAMP APPARATUS

This invention relates to a novel lamp apparatus and more particularly relates to a new rechargeable headband lamp apparatus.

Through the centuries man has employed a variety of different illumination sources to provide light where it is needed. Originally, this involved the use of torches that were held close to the area which was to be illuminated. If an individual needed the use of both hands, the torch was held by another person or else the handle was inserted into the adjacent ground to maintain its position while the work was being done. Later, headpieces such as so-called miner's lamps which included an illumination source such as a gas flame, were positioned on the front of a cap worn by the user.

With the discovery of electricity, lamps were developed that could be placed to illuminate the desired area or surface. Such lamps were restricted in their use to locations that were accessible to electrical power. For locations where electrical power was not readily available, lamps powered by batteries have become common. More recently, flashlights, lanterns and similar illumination sources utilize rechargeable batteries in an attempt to provide dependable illumination without the necessity for periodic changing of batteries.

Although the use of batteries has been successful in some uses, the added bulk and weight of such items has been appreciable. Thus, devices with batteries have not been used where small size and light weight are important considerations. For example, headband lamps employed by doctors for examining a patient utilize power cords connected into an adjacent electrical circuit. However, cords are a nuisance, particularly when a doctor is directing full attention to the patient and requires a high degree of mobility to achieve the best view. One such lamp is described in U.S. Pat. No. 3,371,202.

From the above discussion, it is clear that previous technology does not provide a successful expedient in some applications. Therefore, there is a need for a new lamp which overcomes the shortcomings of earlier devices.

The present invention provides a novel headband lamp apparatus which not only overcomes the deficiencies of previous devices, but also provides features and advantages not found in such devices. The headband lamp apparatus of the present invention provides a dependable light source which is light in weight and small in size. These characteristics are achieved while providing a high degree of mobility and convenience for the user as well as complete portability and safety.

The headband lamp apparatus of the present invention is simple in design and relatively inexpensive. Commercially available materials and components can be utilized in the production of the lamp apparatus. Conventional electrical device fabricating techniques and procedures can be employed by semi-skilled labor in the manufacture thereof.

The headband lamp apparatus of the invention can be used efficiently after a minimum of instruction. The apparatus can be adjusted easily and quickly to accommodate different head sizes and shapes as well as to direct the illumination at the point desired. The lamp apparatus can be stored and recharged conveniently to be ready for use when needed. The lamp apparatus can be modified easily to meet special lighting and/or working conditions.

The apparatus is durable in construction and has a long useful life. Little, if any, maintenance is required to keep the apparatus in good working condition.

These and other benefits and advantages of the novel headband lamp apparatus of the present invention will be apparent from the following description and the accompanying drawings in which.

Figure 1:
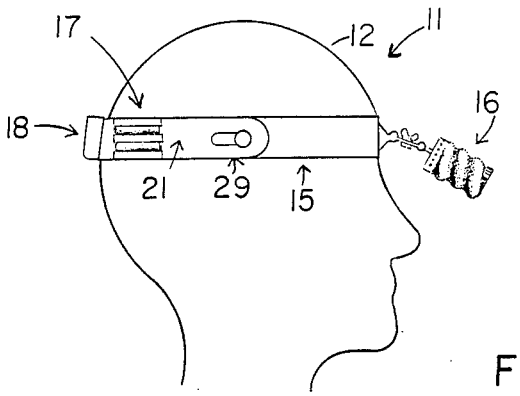
FIG. 1 is a side view of one form of headband lamp apparatus of the invention in use.
Figure 2:
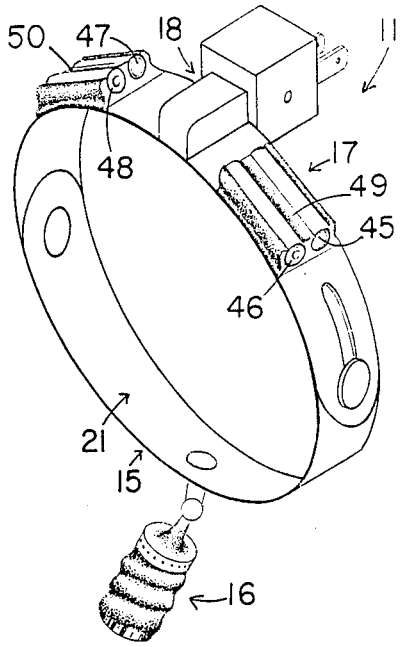
FIG. 2 is a view in perspective of the headband lamp apparatus shown in FIG. 1 being recharged.
Figure 3:
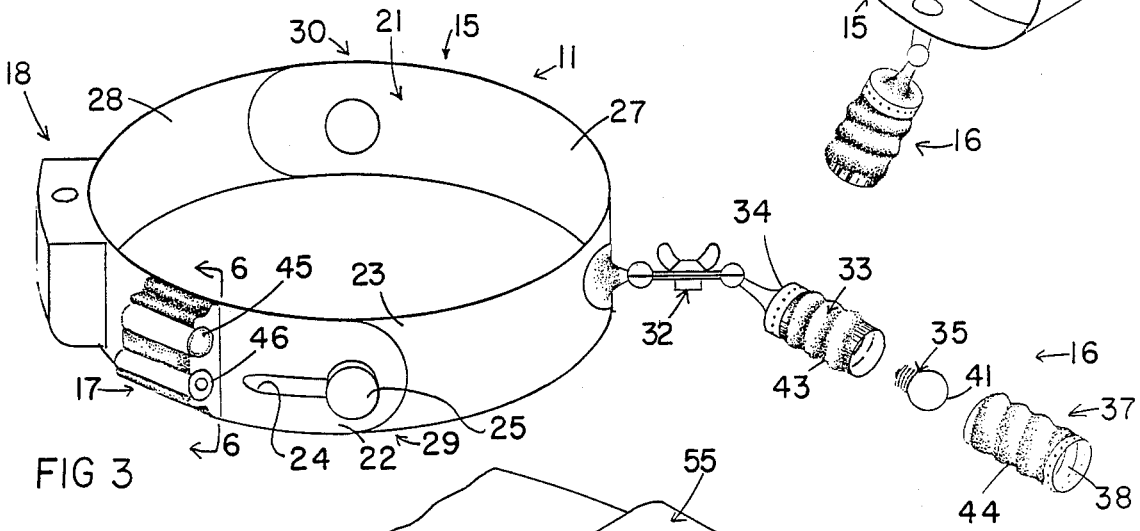
FIG. 3 is an enlarged view in perspective of the headband lamp apparatus shown in FIGS. 1 and 2.
Figure 4:
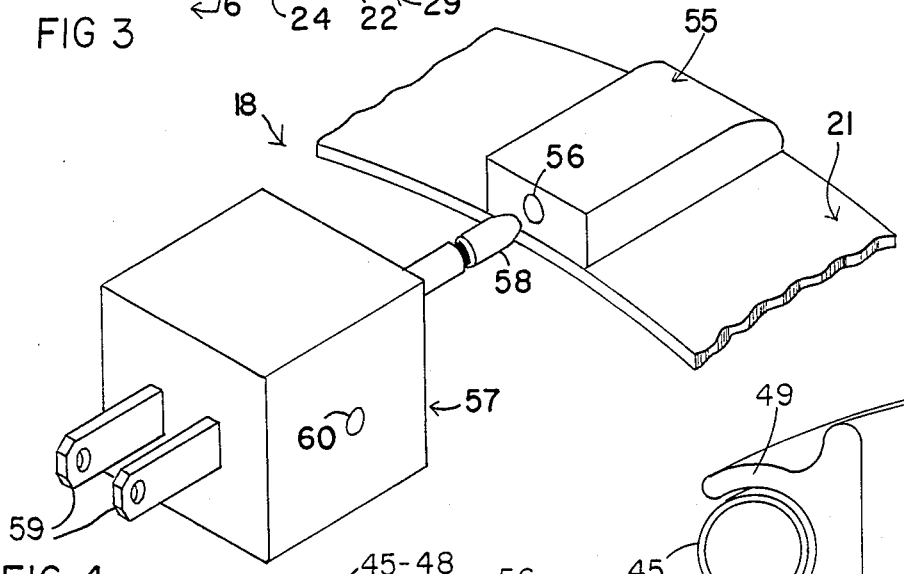
FIG. 4 is a fragmentary reverse view of the headband lamp apparatus shown in FIG. 2 being separated from the recharging portion.

As shown in the drawings, one form of headband lamp apparatus 11 of the present invention is positioned on the head 12 of a person such as a doctor. Light from the apparatus is directed in the line of the user's sight. The headband lamp apparatus 11 includes a band portion 15, a lamp portion 16, a power supplying portion 17 and a recharging portion 18.

The band portion 15 of the headband lamp apparatus 11 of the invention includes an elongated flexible band member 21. One end 22 of the band member is adjustably engageable with an opposite end 23 thereof. Advantageously, one of the ends 22 includes an elongated slot 24 and the other a fastener 25 extending therethrough. To facilitate adjustment of the band member to the user's head, the band member may be divided into more than one segment, e.g. two segments 27 and 28, and thus provide two side adjustment points 29 and 30. The band member preferably is formed of plastic.

The lamp portion 16 of the apparatus 11 of the invention includes an adjustable linkage 32. The linkage 32 extends outwardly from the band member 21. A lamp socket 33 is disposed on a free end 34 of the linkage remote from the band member. An electrical lamp bulb 35 is mounted in the socket 33.

A protective housing 37 surrounds the lamp bulb 35. A lens 38 is located adjacent a free end 39 of the housing. Means 40 is provided for adjusting the spacing between the lens 38 and the adjacent free end 41 of the bulb.

The linkage 32 of the lamp portion advantageously is a pivoting linkage as shown. The lamp bulb employed may be any of the conventional lamp bulbs and preferably is a so-called halogen or krypton bulb which provides high intensity illumination. The means 40 for adjusting the spacing between the lens and the bulb advantageously includes corresponding threaded or grooved sections 43 and 44 along the socket and housing respectively.

The power supplying portion 17 of the headband lamp apparatus 11 includes a plurality of batteries 45, 46, 47 and 48. The batteries are mounted on the band member 21 along the length thereof and are spaced from the lamp portion 16. Each pair of batteries 45, 46 or 47, 48 is retained on the band member 21 with a clip member 49 or 50 that extends outwardly therefrom.

Electrical conductors 52 are disposed along the length of the band member. The conductors 52 electrically connect the lamp portion 16 with the batteries.

Figure 6:
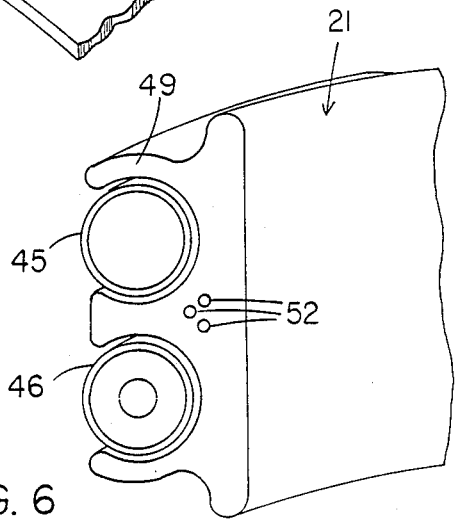
FIG. 6 is a sectional view in perspective of the headband lamp apparatus of FIG. 3 taken along line 6—6 thereof.

The battery holding clip members 49 and 50 advantageously are integrally formed with the band member 21 as shown in FIG. 6. Preferably, the clip members are spaced symmetrically with respect to the recharging portion 18. The conductors 52 advantageously are molded into the band member 21.

The recharging portion 18 of the headband lamp apparatus 11 of the present invention includes a socket member 55. The socket member is disposed along the length of the band member at a point remote from the lamp portion 16. The socket member is connected electrically with the conductors 52. The socket member 55 includes an elongated cavity 56. The axis of the cavity is disposed closely adjacent to and transversely of a longitudinal axis of the band member.

A recharging assembly 57 including a male projection 58 is selectively engageable with the cavity 56 of the socket member 55. Electrical plug elements 59 extend outwardly from the recharging assembly 57 at a point remote from the male projection 58. The recharging assembly 57 includes a signal lamp 60 that is activated while the batteries of the lamp apparatus 11 are being recharged, and also perhaps while coupled.

Figure 5:
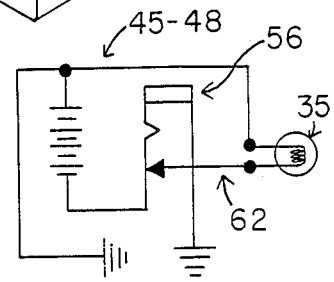
FIG. 5 is a schematic diagram of circuitry of the headband lamp apparatus of the invention.

FIG. 5 schematically illustrates one form of circuitry of the socket member 55. As shown, power from batteries 45–48 to lamp bulb 35 is interrupted by the insertion of the male projection into cavity 56 by opening switch 62. Conversely, when the socket member affixed to the band member 21 is removed from the projection, the switch 62 closes the circuit between the bulb and the batteries and automatically provides illumination.

The circuitry of the recharging assembly 57 may include diodes or other components (not shown) to convert the electrical power. To recharge batteries 45–48, 48, there must be a conversion from the alternating current of the normal electrical circuit of a building into direct current for the batteries.

The headband lamp apparatus of the present invention may be fabricated from materials and components normally employed in conventional illumination devices and appliances. Suitable materials include plastics, metals and combinations thereof. Advantageously, the band member 21, the battery clip members 49, 50, the socket member 55 and the electrical conductors 52 are molded as a unitary structure.

In the use of the headband lamp apparatus 11 of the present invention, the plug elements 59 of the recharging assembly 57 are inserted into a conventional outlet socket of a building electrical circuit (not shown). The cavity 56 of the socket member 55 is engaged with the projection 58 that extends outwardly from the recharging assembly. With these components engaged, the band member 21 of the apparatus 11 extends downwardly from the socket member in a vertical orientation closely adjacent to the wall surface of the building outlet and generally parallel thereto.

After the batteries 45–48 of the apparatus are fully charged, charging automatically stops and the signal lamp 60 of the recharging assembly goes out. Thereafter when needed, the user, e.g. a doctor, removes the apparatus from the projection of the recharging assembly and places the band member around his head. The band member is tightened by increasing the overlap of the ends of the band member and thereby decreasing the circumference thereof.

With the band member 21 properly positioned on the head, the user manipulates the linkage 32 to direct the light beam from bulb 35 in the desired area of the patient being examined. The light beam is focused by rotating housing 37 with respect to the lamp bulb 35 so the lens 38 moves closer or farther from the bulb. Since the lamp energizes automatically upon being separated from the recharging assembly, the user does not have to activate the circuitry.

Upon completing the examination, the user simply removes the lamp apparatus 11 from his head and returns it to the recharging assembly by re-engaging the socket member 55 with the projection 58. The engagement automatically de-energizes the lamp bulb 35 and begins the recharging of the batteries. Thus, in a single step of re-engaging the socket member with the recharging assembly, the user accomplishes the shutting off of the lamp bulb, the storage of the apparatus safely out of the way and the recharging of the batteries. The lamp apparatus 11 is ready for use when needed with the batteries fully charged and the above steps are repeated with each use of the apparatus.

The above description and the accompanying drawings show that the present invention provides a novel headband lamp apparatus which overcomes the deficiencies of previous illuminating devices and in addition provides features and advantages not found in such earlier devices. The headband lamp apparatus of the invention is completely portable and can be used conveniently with a high degree of mobility and without restriction from power cords. The apparatus is light in weight and easily adjusted to focus light on a desired point or area.

The headband lamp apparatus is simple in design and relatively inexpensive. Fabrication thereof can be achieved using commercially available materials and components with semi-skilled labor and conventional electrical device fabricating techniques.

The headband lamp apparatus of the invention can be used efficiently by persons of all ages and modified easily for special lighting and/or working conditions. The apparatus is recharged and stored conveniently and ready for use when needed. The apparatus is durable in construction and has a long useful life.

It will be apparent that various modifications can be made in the particular headband lamp apparatus described in detail above and shown in the drawings within the scope of the present invention. The size, configuration and arrangement of components can be changed to meet specific requirements. The linkage of the lamp portion can be a continuously flexible member. The lamp and socket can be of a different design. These and other changes can be made in the headband lamp apparatus provided the functioning and operation thereof are not adversely affected. Therefore, the scope of the present invention is to be limited only by the following claims.

What is claimed is:

1. Headband lamp apparatus including a band portion, a lamp portion, a power supplying portion and a recharging portion; said band portion including an elongated flexible plastic band member, said band member including at least two substantially equal segments, one end of each segment being adjustably engageable with an opposite end of said other segment through an elongated slot; said lamp portion including an adjustable linkage extending outwardly from said band member, a lamp socket disposed on a free end of said linkage remote from said band member, an electrical lamp bulb mounted in said socket, a protective housing surrounding said lamp bulb, a lens located adjacent a free end of said housing, said housing threadedly adjusting the spacing between said lens and said free end of said lamp bulb; said power supplying portion including two pairs of thin elongated cylindrical batteries mounted longitudinally parallel of said band member on clip members symmetrically spaced from said socket member of said recharging portion and spaced from said lamp portion, each pair of said batteries being retained on said band member with an open clip member integrally formed therewith and extending outwardly from said band member, electrical conductors molded into said band member disposed along the length of said band member electrically connecting said lamp portion with said batteries; said recharging portion including a socket member disposed along the length of said band member remote from said lamp portion and connected electrically with said conductors, said socket member including an elongated cavity, the axis of said cavity being closely adjacent to and transverse of a longitudinal axis of said band member, a recharging assembly including a male projection selectively engageable with said cavity of said socket member, electrical plug elements extending outwardly from said recharging assembly in a direction opposite to said male projection, said recharging assembly including a signal lamp activatable when said apparatus is being recharged, said socket member including circuitry automatically interrupting power from said batteries to said lamp bulb when said cavity of said socket member engages said male projection and automatically re-energizes said lamp bulb when said cavity is separated from said male projection; whereby said lamp apparatus can be placed around a user's head and positioned by adjusting the fit of said band member, said lamp focused to provide illumination of an area in the line of sight, and the lamp apparatus recharged automatically when not in use by engaging said cavity of said socket member with said male projection of said recharging assembly while said plug elements thereof are connected to an electrical circuit.

2. Headband lamp apparatus according to claim 1 wherein said lamp portion includes a pivotable linkage.

* * * * *